US006939276B2

(12) United States Patent
Gates

(10) Patent No.: US 6,939,276 B2
(45) Date of Patent: Sep. 6, 2005

(54) BOYANCY RESISTANCE EXERCISE SYSTEM

(76) Inventor: W. Burnell Gates, 8410 Hwy. 87E, San Antonio, TX (US) 78263

( * ) Notice: Subject to any disclaimer, the term of this patent is extended or adjusted under 35 U.S.C. 154(b) by 438 days.

(21) Appl. No.: 09/916,906

(22) Filed: Jul. 27, 2001

(65) Prior Publication Data

US 2003/0022766 A1 Jan. 30, 2003

(51) Int. Cl.[7] ..... A63B 21/00
(52) U.S. Cl. ..... 482/111; 462/106; 462/108
(58) Field of Search ..... 482/111–113, 106–108, 482/482, 96, 55

(56) References Cited

U.S. PATENT DOCUMENTS 4,566,690 A * 1/1986 Schook
5,090,693 A * 2/1992 Liang
5,203,753 A * 4/1993 Rothhammer
5,464,379 A * 11/1995 Zarecky
5,531,657 A * 7/1996 Macedo
5,885,123 A 3/1999 Clifford ..... 441/129

* cited by examiner

*Primary Examiner*—Jerome W. Donnelly
(74) *Attorney, Agent, or Firm*—Jackson Walker LLP.

(57) ABSTRACT

A device for exercising when partially submerged in water. The device includes a dumbbell shaped floatation member for providing buoyant resistance once submerged underwater. This dumbbell shaped member can accept extensions on either end thereof. A second dumbbell member and a second pair of extensions is provided. A third component of the buoyancy system is a buoyancy member that would threadably engage both dumbbell shaped members to provide for a barbell shaped device for submerging underwater and providing buoyant resistance for the user to work against. The pairs of extension may be threadably engaged either end of the barbell member.

5 Claims, 3 Drawing Sheets

BOYANCY RESISTANCE EXERCISE SYSTEM

FIELD OF THE INVENTION

Exercise systems, more specifically an exercise system using the buoyancy of a submerged buoyant element as resistance for an "in water" exercise.

BACKGROUND OF THE INVENTION

Proper exercise is necessary to maintain good health and for proper rehabilitation from injury. There are many forms of exercise, each with their own advantages and disadvantages. One disadvantage to traditional forms of exercise such as free weight lifting is the tremendous stress which it concentrates on the joints and bones of the user. For the elderly or infirm, focusing pressure on the joints may be debilitating. Often, in such cases, a water borne exercise such as swimming is beneficial. When one is at least partially underwater they enjoy the natural buoyancy of the body. Furthermore, exercise underwater, at least partially, will release stress on the participants joints.

Applicant provides a novel system, including a multiplicity of elements, which will include boyant elements to function, when submerged, as resistance to a user at least partially submerged in water.

Applicant's system provides the advantages of underwater exercise with the advantages of a free weight system. That is, Applicant's provide the ability to configure an exercise element to conform to the shape and resistance desired by the underwater exercise participant in much the same way as the traditional land borne free weight lifter will remove and change elements, such as a plate, from a mounting system, such as a dumbbell or barbell in order to afford greater or less resistance.

SUMMARY OF THE INVENTION

A device for exercising when partially submerged in water. The device includes a dumbbell shaped floatation member for providing buoyant resistance once submerged underwater. This dumbbell shaped member can accept extensions on either end thereof A second dumbbell member and a second pair of extensions is provided. A third component of the buoyancy system is a buoyancy member that would engage both dumbbell shaped members to provide for a barbell shaped device for submerging underwater and providing buoyant resistance for the user to work against. The pairs of extension may be threadably engaged to either end of the barbell member.

DETAILED DESCRIPTION OF THE PREFERRED EMBODIMENT

Figure 1:
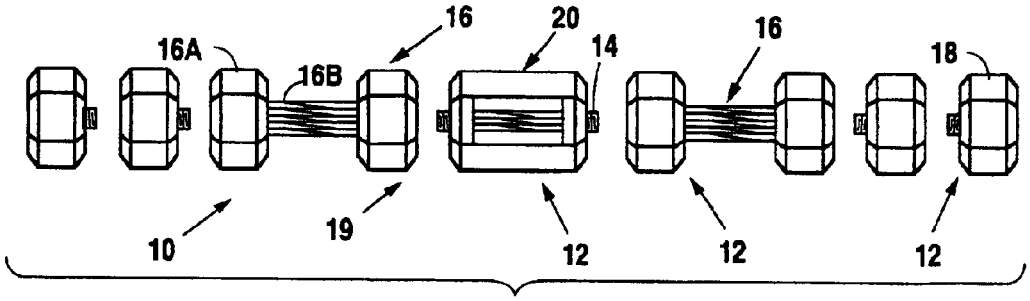
FIG. 1 is an exploded view of elements of Applicant's buoyancy system.
Figure 1A:
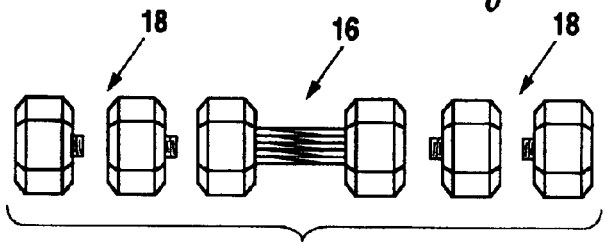
FIG. 1A is an exploded elevational view of a dumbbell of Applicant's buoyancy system with a pair of extension members for threadable engagement to the removed ends thereof.
Figure 3:
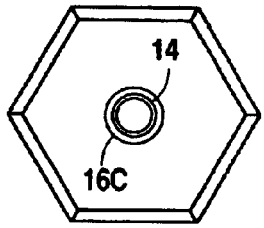
FIG. 3 is elevational end view of a dumbbell of Applicant's present invention.

With reference to the figures it is noted that Applicant's provide a buoyancy resistance exercise system (10) for providing resistance to an at least partially submerged or water borne user. Applicant's system is typically comprised of at least two (2) primary components: buoyant elements (12) and buoyant element mounting members (14).

Buoyant elements (12) are comprised of a material that has a specific gravity of less than one. Such a material will float on water. One such material is ETHAFOAM.RTM., a foamed plastic available from Don Chemical. In floating on the surface of the water material comprising a buoyant element will displace a mass of water equal to the weight of the element. Force must be applied externally to submerge the element in the water. Further, a downward force must be applied to maintain the buoyant element underwater. The force required to maintain the buoyant element underwater is equal to the weight of the mass of the water displaced in submerging the floating element. Therefore, for any given material the greater its volume the greater the buoyancy force ( force urging the submerged buoyant element towards the surface of the water).

Turning again to the figures it is noted that buoyant elements (12) may be dimensioned and shaped to accept a buoyant element mounting member (14), such as a cylindrical PVC pipe consisting of multiple threadable engagement portions thereon.

Applicant's buoyancy resistance system is seen in FIG. 1 to have buoyant elements (12), some defined or shaped to mimic dumbbells (16) that is, to have traditional enlarged dumbbell end masses (16A) joined by cross members (16B) for grasping with ones hand there between. Here, for example dumbbell (16) may be made from buoyant element (12) such as foam or other lightweight floatable material that is shaped to have an extension or cross member (16B) between two (2) removed end portions, the extension having a length and diameter for easy grasping.

A dumbbell, for example, may be grasped about the cross member (16B) while floating in water. The user may then force it underwater and work against the buoyancy force created by the submergence in doing a number of exercise motions such as curls, leg lifts, rowing motion, paddling motion, reverse curls etc. (See FIGS. 6A and 6B)

Figure 2:
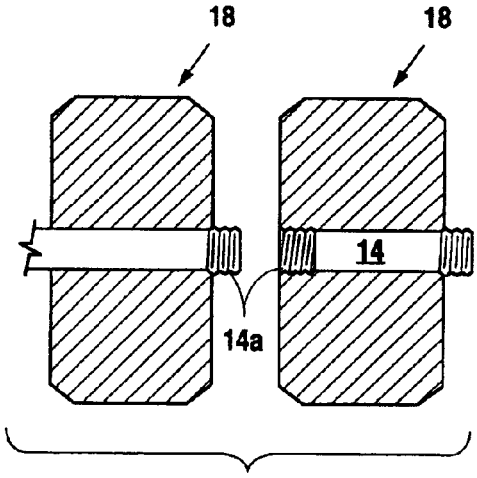
FIG. 2 is a cutaway elevational view of extension members of Applicant's present invention showing how two elements of the invention, here for example, two extension members, may threadably engage one another.

Applicant's dumbbell and other boyant elements typically has an elongated central channel (16C), coincident with the longitudinal axis defined therein for snug receipt of boyant element mounting member (14), such as a length of PVC pipe, therein. Further, it is seen with reference to the figures that Applicant's boyancy resistance system (10) may include one or more extension members (18) which extension members also comprise buoyant element mounting members (14) as part thereof and which may include threaded engagement portions 14A (male and female) to threadable engage portions of the dumbbell or other elements of the resistance system (See FIG. 2). The buoyant elements mounting member (14) may be threaded PVC pipe, and any of the separate elements of the system may include the pipe or mounting member centrally located on a longitudinal axis thereof adhesively joined to shaped longitudinal cavity therethrough, with ends for threadable engagement to either the dumbbell or dumbbell joinder element (20).

With referenced to FIGS. 1, 5A, 5B and 5C, It is seen now that Applicant's system includes dumbbells (16) with extensions (18) threadable or otherwise removably attachable thereto which dumbbells may be used separately and apart from other elements of Applicant's resistance system. However, the dumbbells may be joined together through a dumbbell joinder element (20) (See FIG. 1) which, like the other elements of the system, is comprised at least partially of a buoyant material that will float and therefor provide a buoyancy force resistance to the user as well as buoyant elements mounting member (14) thereon. Also, a third dumbbell may function to join to other dumbbells (See FIGS. 5A–C). In FIG. 1 the dumbbell joinder element is seen to have buoyancy element mounting member extending from paired opposed faces thereof for threadable joining the two (2) dumbbells to create a barbell (19). The barbell, here created by at least the joinder of dumbbells (16), one on either side of the dumbbell joinder element (20) may be grasped by the user by the placement of hands on the cross members (16B) of each of the two (2) dumbbells and used in barbell fashion for underwater exercise.

It is seen also that Applicant's system may increase the underwater resistance created by the buoyancy force with the addition of one or more extensions (18) to the ends of the barbell (19) created by the joinder of the two (2) dumbbells to the dumbbell joinder element (20). Also, the extensions may be placed between the centrally located joinder element and the two dumbbells so as to advst the width between the barbell users hands. It can be seen that Applicant's system allows the user to perform a variety of dumbbell or barbell exercises and to modify the buoyancy force resistance created by the dumbbell or barbells by the appropriate addition of extensions.

Figure 3A:
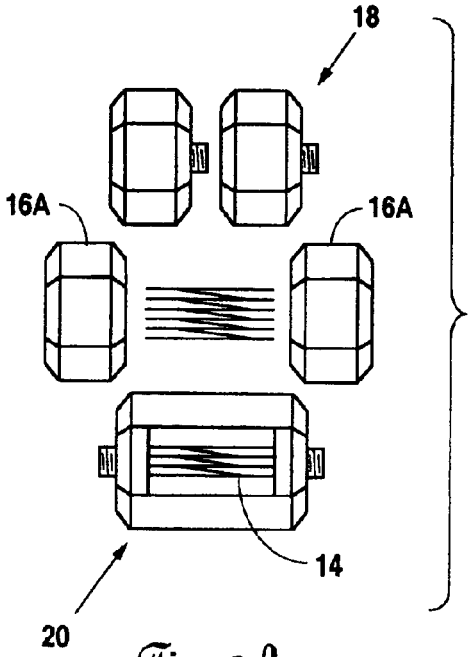
FIG. 3A is an exploded view showing how some of the components of Applicant's present are dimensioned to fit together for shipment and storage.

Furthermore, it is seen that such a system is compact (See FIG. 3A). More specifically note that the width of the dumbbell joinder element may be just slightly less than the distance between the inner faces of the dumbbell end masses (16A). Furthermore, extensions (18) may be paired together such that the combined width of two will fit snuggly within the aforementioned distance between the inner faces of each of the dumbbells so as to provide compact shipment and storage of the system.

Figure 4:
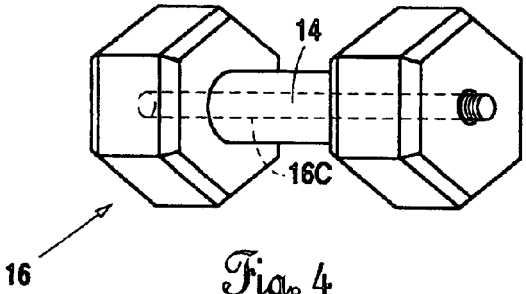
FIG. 4 is an isometric view with ghosted lines showing the central channels through the center of a dumbbell for engagement with a mounting member.
Figure 4A:
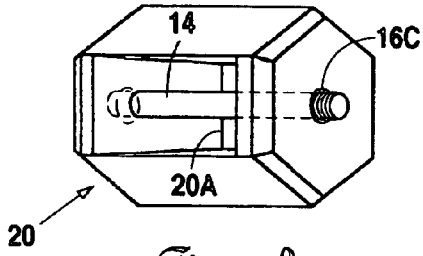
FIG. 4A is an isometric view of an embodiment of Applicant's dumbbell joinder element.
Figure 5A:
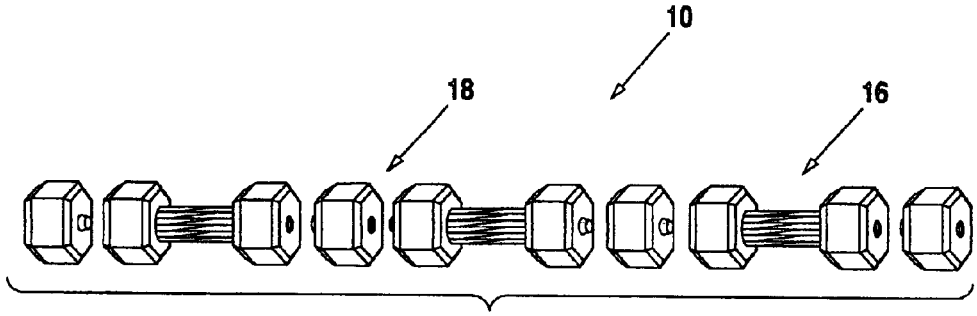
FIGS. 5A, 5B, and 5C illustrate the use of a third dumbbell as a dumbbell joinder element and three of a number of combinations of dumbbells and extensions and joinder elements that may be used to engage one another to form a barbell.
Figure 5B:
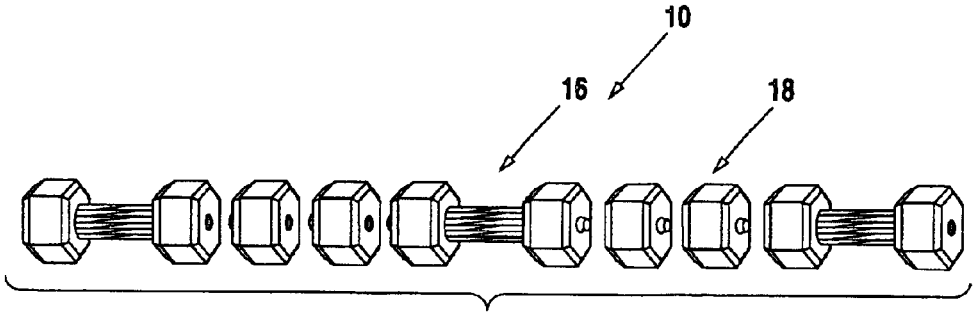
Figure 5C:
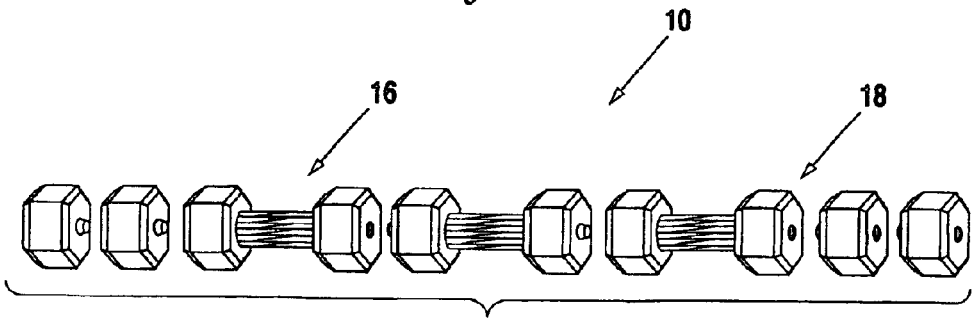

Note in FIG. 1 and FIG. 4A that dumbbell joinder element (20) may contain walls defining a cutout central section (20A). In such an optional preferred embodiment of dumbbell joinder element (20) such walls provide for the easy receipt of the foot portion of the user so as to convert this dumbbell joinder element (20) into a separate element for exercising the lower extremities of the users body. Dumbbell joinder element, however, may take any shape so long as is central between the dumbbell so as to located them.

Thus, we have seen that Applicant provides in a buoyancy resistance system the following:

1. At least a pair of dumbbells that may be used separately.
2. Dumbbells joinable with a dumbbell joinder element to convert the system into a single barbell utilizing two (2) dumbbells.
3. Dumbbells with the capability of adding on extensions for increase buoyancy resistance.
4. A barbell capable of receiving extensions for increase for buoyancy resistance.
5. A foot or leg engaging element for buoyancy resistance to exercise legs.

Figure 6A:
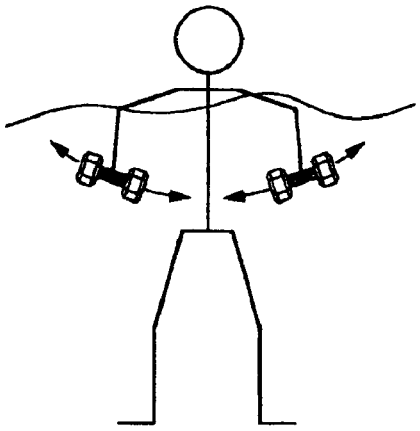
FIGS. 6A, 6B, and 6C illustrate a method of using both the dumbbells and the barbells of Applicant's present invention for arm exercises while partially submerged in water.
Figure 6B:
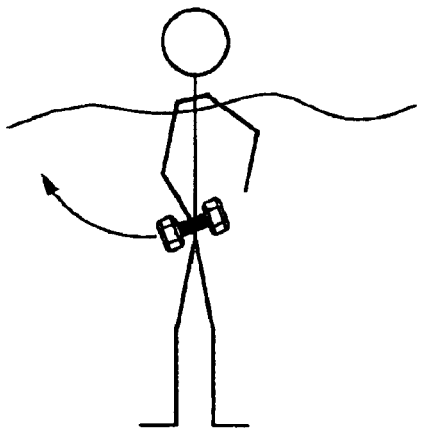
Figure 6C:
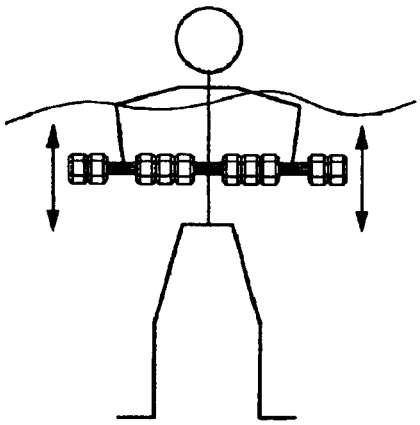
Figure 7:
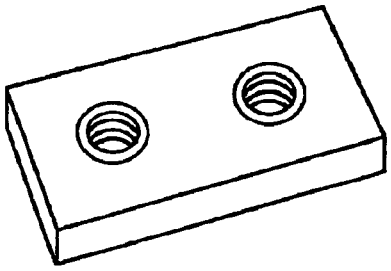
FIG. 7 is a videotape including instructions for putting together and using components of Applicant's buoyancy system.

FIGS. 6A through 6C illustrate a user enjoining the benefits of Applicant's system, partially submerged in water. Here it is seen that either the dumbbells alone or joined to from a barbell (See FIG. 6C) may be moved underwater such that a component of the motion is downward (for movement against the resisting buoyancy force). Applicant's also provide a videotape illustrated here in FIG. 7, to provide instructions for assembly of the components of Applicant's system and also to provide examples of various exercises that my be done utilizing Applicant's novel system.

While Applicant's system above has been illustrated using floatation elements having a mounting member, such as PVC pipe, it is also anticipated that Applicant's novel system may included elements molded with joinder elements integral therein. For example, a hard plastic waterproof shell may be molded with the air captured inside the shell to provide the buoyancy and with the shell including threaded male and/or female engagements extending from the outer faces thereof.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An exercise system for use submerged in water, the exercise system comprising: a first floatation element having a grasping member having first and second ends and including a pair of buoyant masses on the said ends of the grasping member, a second floatation element, and a third floatation element, the floatation elements having a specific gravity of less than one, the second and third floatation elements being adapted to engage the first floatation element, the second and third floatation elements each having grasping members and a pair of buoyant masses on the ends thereof; a first pair of extension members for releasably engaging the buoyant masses of the first floatation element, the first pair of extension members comprising a material with a specific gravity of less than one; the second floatation element having a grasping member and pair of buoyant masses at the removed ends thereof, the second floatation element having a specific gravity of less than one; a second pair of extension members for engaging the buoyant masses of the second floatation element, the second pair of extension members having a specific gravity of less than one; means for releasably joining the first floatation element to the second floatation element, wherein means for releasably joining the first floatation element to the second floatation element at least partially comprises a material with a specific gravity less than one wherein the material comprising at least part of the first floatation element is foam.

2. The exercise system of claim 1 further including means for releasably joining the first floatation element to the third floatation element.

3. The exercise system of claim 1 wherein at least the first floatation element and the second floatation element have indicia thereon.

4. The exercise system of claim 3 wherein the indicia reflects the buoyancy of the element it is placed upon.

5. The exercise system of claim 1 further including a videotape to provide instructions for assembly of the components thereof.

* * * * *